United States Patent [19]

Maeder

[11] Patent Number: 4,949,873

[45] Date of Patent: Aug. 21, 1990

[54] SEMI-CIRCULAR PLUNGERS FOR A PLURAL COMPONENT DISPENSER

[76] Inventor: August Maeder, Hurdnerwaeldli Strasse 42, 8808 Pfaeffikon/Sz, Switzerland

[21] Appl. No.: 344,581

[22] Filed: Apr. 28, 1989

[30] Foreign Application Priority Data

Apr. 29, 1988 [DE] Fed. Rep. of Germany ..... 3814633

[51] Int. Cl.[5] ..... B67D 5/42

[52] U.S. Cl. ..... 222/135; 222/386

[58] Field of Search ..... 222/135, 137, 145, 386, 222/390, 391, 327, 1, 136

[56] References Cited

U.S. PATENT DOCUMENTS

| | | | |
|---|---|---|---|
| 3,250,443 | 5/1966 | Abbott, Jr. | 222/327 |
| 4,030,643 | 6/1977 | Van Manen | 222/386 |
| 4,169,547 | 10/1979 | Newell | 222/386 |
| 4,179,050 | 12/1979 | Farrell, III et al. | 222/386 |
| 4,240,566 | 12/1980 | Bergman | 222/135 |
| 4,269,330 | 5/1981 | Johnson | 222/386 |
| 4,366,919 | 1/1983 | Anderson | 222/137 |
| 4,452,370 | 6/1984 | Langensiepen et al. | 222/386 X |
| 4,771,919 | 9/1988 | Ernst | 222/145 X |
| 4,854,485 | 8/1989 | Collins | 222/386 |

FOREIGN PATENT DOCUMENTS 659629 2/1987 Switzerland ..... 222/386

*Primary Examiner*—Kevin P. Shaver

*Attorney, Agent, or Firm*—Foley & Lardner, Schwartz, Jeffery, Schwaab, Mack, Blumenthal & Evans

[57] ABSTRACT

A container for storing and dispensing various fluid substances with a cylindrical housing that is divided into two chambers by a partition wall positioned along the longitudinal axis of the housing. Each chamber includes a closed end with an outlet opening and an open opposite end. A semicircular shaped plunger fits in the chamber that is slidably displaceable towards the outlet opening. A first portion of each plunger is formed with a chamber facing the fluid substance stored in the chamber. An outside edge of the first portion forms a lip seal between the plunger and the interior side wall of the chamber. On the opposite side of the plunger a second portion includes several ribs that are adapted to receive a pressure plate against which an operating pressure is applied using a known pressure device. Each outlet opening is hermetically sealed by a plug seal held in place by a collar nut.

7 Claims, 2 Drawing Sheets

A
A
9
10
11
11
12
13
15
16
17
18
19
20

SEMI-CIRCULAR PLUNGERS FOR A PLURAL COMPONENT DISPENSER

FIELD OF THE INVENTION

This invention relates to container apparatus for storing various fluids in mutually isolated relation and more particularly to container apparatus adapted to dispense the various fluids in predetermined amounts through a mixing nozzle.

BACKGROUND OF THE INVENTION

Containers having mechanisms for discharging predetermined quantities of fluid substances with different viscosities are known, and usually make use of a moveable plunger which functions interiorly of a cylindrical container. These containers are well adapted to dispensing a predetermined amount of homogeneous substances such as single component adhesives, for example.

In the case of two-component fluid mixtures, as for instance in epoxy adhesives, two of the aforenoted containers are often used to store individual ones of the components in isolated relation with each other. When a quantity of adhesive is required, individual components are expressed from their respective containers and subsequently mixed. Such a procedure is both awkward and time consuming.

A container for fluid substances that purportedly avoids the aforenoted disadvantages is disclosed in Swiss Patent No. 659,629. The disclosed container is both simple in construction and economical of manufacture and is adapted to store separately both components of a two-component mixture. The separately stored components of, for example, the aforenoted epoxy adhesive are simultaneously expressed from respective containers through a screw-on type mixing nozzle wherein both components are thoroughly mixed before application to a workpiece. By simultaneously moving two semicircular shaped plungers within the containers using suitable means for expressing the components, equal amounts of the components are discharged from each chamber and provide a constant mixture ratio.

SUMMARY OF THE INVENTION

Having regard to the aforedescribed problems related to containers that store and dispense various fluids, a principal object of the present invention is to improve the containers of the prior art, as typified in the aforenoted Swiss patent, by assuring an optimum sealing effect of each plunger and to effectively prevent air intake after use and extended storage of the container contents.

The problems associated with the prior art may be substantially overcome and the foregoing objective achieved by recourse to the invention which relates to a container for fluid substances that comprise a cylindrical housing which is divided into two separate chambers by means of a partition wall formed as an integral part of the housing in a longitudinal axis thereof. Each one of the chambers includes an outlet opening at a top end thereof and a semicircular plunger that is slidably disposed within the chamber in the direction of the outlet opening. The plunger includes a first portion having a camber facing the fluid substance in the chamber and a second portion on the opposite side of the plunger on which is disposed a plurality of ribs that are adapted to accept a pressure plate. Along an outside edge of the first portion, a lip seal is formed as an integral part of the plunger with an outside surface of the lip seal being set at a predetermined angle to and extending beyond the plunger wall.

An advantage to be realized from the plunger according to the present invention is achieved when the pressure plate is pressed against the ribs. A counter pressure is consequently exerted on the lip seal by the camber of the plunger first portion whereby the diameter of the plunger is increased. This enlargement of the plunger diameter assures that during expression of the container contents, an optimal seal is formed between the lip seal and the interior side wall of the container.

BRIEF DESCRIPTION OF THE DRAWINGS

The invention will now be more particularly described with reference to an embodiment thereof shown, by way of example, in the accompanying drawings in which.

DETAILED DESCRIPTION OF A PREFERRED EMBODIMENT

Figure 1:
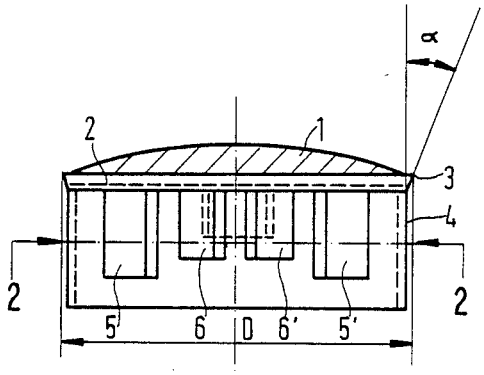
FIG. 1 is a sectional view of a plunger in accordance with the present invention.
Figures 3, 4, 5, 6, 7:
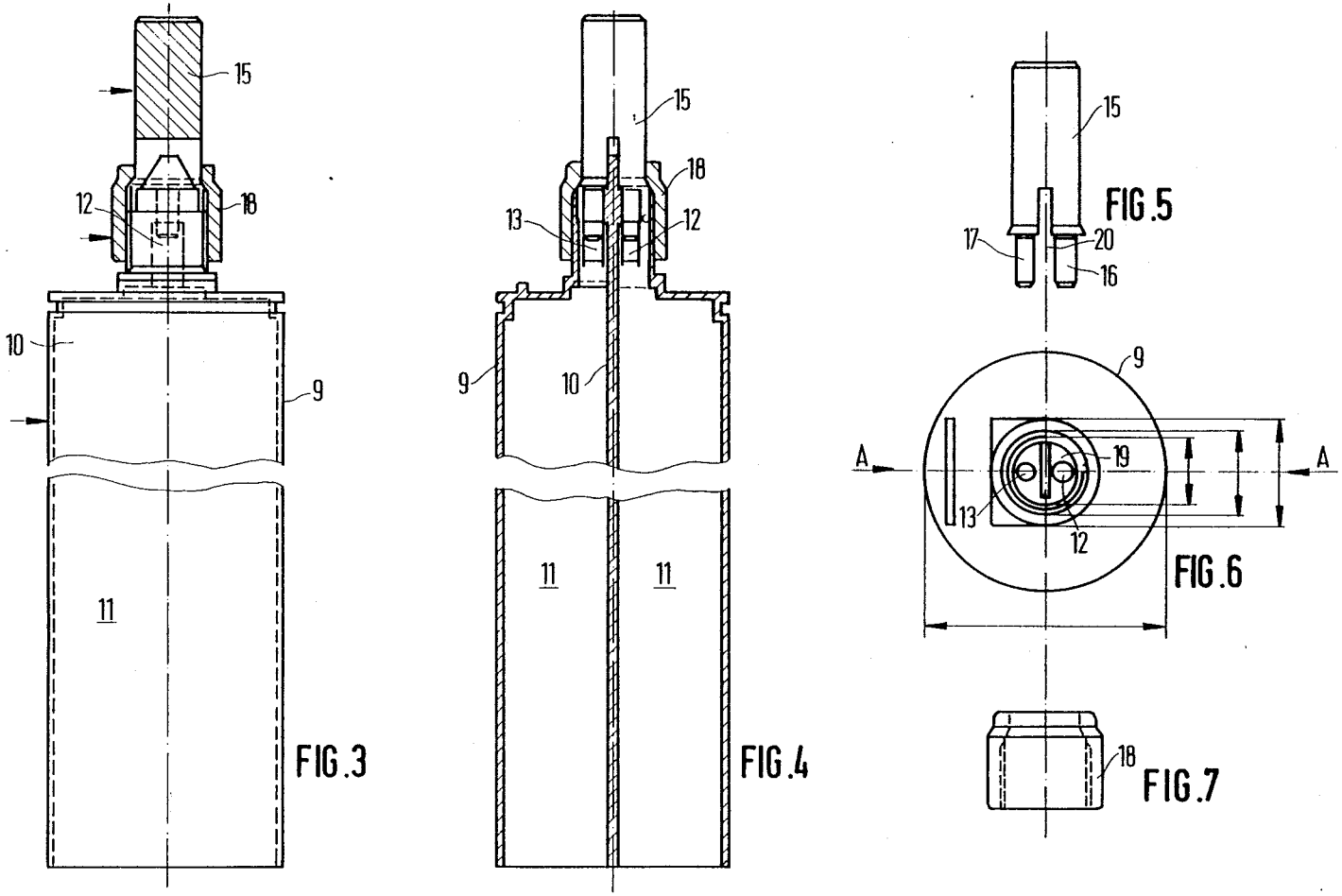
FIG. 3 is a lonfitudinal sectional view of a container for fluid substances showing a side elevation of a partition wall that bisects the container into two equal semicylindrical containers.
FIG. 4 is a sectional view of FIG. 3, rotated 90°.
FIG. 5 is a side elevation view of a plug seal.
FIG. 6 is a top plan view of the container of FIGS. 3 and 4.
FIG. 7 is a side elevation view of a collar nut for the plug seal of FIG. 5.

The side elevation view in FIG. 1 of a semicircular shaped plunger according to the invention is intended for use in a two component cartridge as illustrated in FIG. 3. It will be understood that the plunger is disposed within each semicylindrical chamber 11 towards the top thereof and is in contact with a fluid substance (not shown) stored in the container 9. A first portion 8 of the plunger has formed along its entire circumference a plunger wall 4 that is perpendicular to the plunger first portion.

On the opposite side of the plunger first portion 8 and interiorly of the plunger wall 4, several ribs 5, 5' , 6 and 6' (FIGS. 1 and 2) are shown. These ribs connect a semicircular shaped portion of the plunger wall 4 with a portion of the plunger wall that corresponds to the diameter of the plunger, so that it can accept a semicircular shaped pressure plate which will move the plunger towards a pair of outlet openings 12 and 13.

As may be seen in FIG. 1, two outside ribs 5 and 5' have a greater height than two inside ribs 6 and 6'. As a result of this arrangement, the pressure plate when inserted interiorly of the plunger wall 4 will first make contact with the ribs 5 and 5'.

Along the outside edge of the plunger first portion 8 is a lip seal 2 which is arranged such that its outside surface 3 extends beyond the diameter of the wall 4 and at a predetermined angle $\alpha$ thereto which can vary from between 10° to 30°. A preferred angle, however, is about 20°.

Shown between the inside ribs 6 and 6' is a cylindrical reinforcement 7.

The two plungers are slidably disposed within the two separated chambers 11 of the container 9 in a known manner and are displaceable in parallel relation with one another, by pressure applied via corresponding pressure plates, in the direction of the outlet openings 12 and 13. Each pressure plate in insertable interiorly of the plunger wall 4 and will make first contact with the ribs 5 and 5' as previously noted. As each plunger is moved forwardly, a camber 1 portion produces a counter-pressure on the lip seal 2, thereby enlarging the diameter of the plunger along the lip seal 2 to produce an optimal seal within the chamber 11. The pressure can be increased to the point where the ribs of greater height 5 and 5' are paressed together. As a result, the pressure plate will then press against the inside ribs of lower height 6 and 6'.

In one embodiment of the invention, a distance "D" between the outside edges of the lip seal 2 is 60 mm. A distance "d" of the straight line portion of the plunger wall 4 is 58 mm. The thickness of each one of the ribs 5 and 6 is 1.5 mm and the wall thickness "a" of the plunger wall 4 is 2 mm.

FIG. 3 is a sectional view of the container 9 for fluid substances shown as a two-component cartridge. The container 9 is cylindrical and is subdivided into two symmetrical chambers 11 of equal size, along the longitudinal axis thereof, by means of a partition wall 10. The chambers 11 do not communicate with each other and each chamber 11 has at its top end an outlet opening 12, 13 which can be individually sized for predetermined flow control. As best seen in FIG. 4, the outlet openings 12 and 13 are separated from each other by means of an extension of the partition wall 10.

Both outlet openings 12 and 13 can be located in an outlet nozzle 19 as may be seen in FIG. 6. It will be understood that the nozzle 19 is provided with an outside thread onto which a collar nut 18 can be screwed. The outlet openings 12 and 13 can be equal or different in diameter in order to provide a selectable but constant mixture ratio of the two components stored in the separated chambers 11.

Normally the container 9 is closed by means of a plug seal 15 (FIG. 5). As shown in FIGS. 3 and 4, two protrusions 16 and 17 of the plug seal 15 are separated from one another and are adapted to fit tightly into outlet openings 12 and 13 in order to close same with an air tight seal. Concurrently, the protrusions 16 and 17 are inserted into the substances contained within the chambers 11 and the plug seal 15 is held in place by the nut 18. As a result, even after partial use of the substances stored within the chambers 11, the remainder can be stored for upwards several months without deterioration before subsequent further use.

The inside diameter of the collar nut 18 (FIG. 7) is advantageously fitted with a ring collar rib extending interiorly of the collar nut 18 so that a clamp effect results between the collar nut 18 and the plug seal 15. After removal of the plug seal 15 by unscrewing the collar nut 18, a mixing nozzle (not shown) may be screwed onto the outside threads of the outlet nozzle 19.

Figure 2:
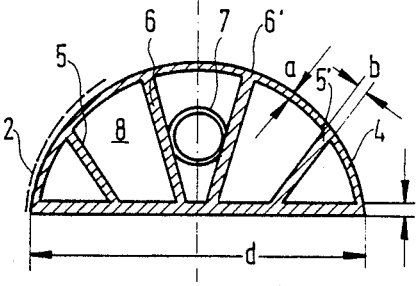
FIG. 2 is a cross-sectional bottom plan view of the plunger of FIG. 1 taken along the lines A—A.

Each one of both chambers 11 is fitted with a plunger according to the embodiment illustrated in FIGS. 1 and 2. Both plungers can be simultaneously moved towards the outlet openings 12 and 13 by means of two symmetrically arranged pressure plates which are inserted into the chambers 11 and then pressed into contact with the plungers as heretofore described using known means, not shown, to apply pressure. As a result, a constant predetermined mixing ratio of both components is expressed towards and through the outlet nozzle 19.

The embodiments of the invention in which an exclusive property or privilege is claimed are defined as follows:

1. A container for fluid substances, the container comprising a cylindrical housing divided into two separate chambers by means of a partition wall formed as an integral part of the housing along a longitudinal axis thereof, and each one of the chambers having an outlet at a forward end thereof, and a semi-circular shaped plunger having a pair of sides, slidably disposed in each manner, comprising:

(a) a camber portion on one side of the plunger in contact with the fluid substance within the chamber;

(b) a plurality of inside and outside ribs, having free ends extending perpendicularly from the other side of the plunger for contacting a pressure plate, the outside ribs having a different height from the inside ribs and the inside ribs positioned between the outside ribs;

(c) a side wall extending rearwardly from the camber portion; and (d) a lip seal formed as an integral part of the plunger along an outside edge of the camber portion, the lip seal having an outside surface set at a predetermined angle to and extending beyond the side wall.

2. A plunger according to claim 1, wherein there are two outside ribs and two inside ribs of lesser height.

3. A container according to claim 1, further comprising at least one cylindrical reinforcement positioned between the inside ribs.

4. A container according to claim 1, wherein the predetermined angle of the lip seal to the side wall is between 10° to 30°.

5. A container according to claim 1, wherein the predetermined angle is 20°.

6. A container according to claim 1, wherein the container has a plug seal with a pair of protrusions adapted to sealingly fit into the outlets.

7. A method for sealing a container for fluid substances comprising:

(a) providing a container having a cylindrical housing divided into two separate chambers by means of a partition wall formed as an integral part of the housing along a longitudinal axis thereof, each one of the chambers having an outlet at a forward end thereof;

(b) providing a semi-circular shaped plunger having a pair of sides slidably disposed in each chamber, the plunger comprising:

(1) a camber portion on one side of the plunger in contact with the fluid substance within the chamber;

(2) a plurality of inside and outside ribs, having free ends extending perpendicularly from the other side of the plunger for contacting a pressure plate, the outside ribs having a different height from the inside ribs and the inside ribs positioned between the outside ribs;

(3) a side wall extending rearwardly from the camber portion; and (4) a lip seal formed as an integral part of the plunger along an outside edge of the first camber, the lip seal having an outside surface set at a predetermined angle to and extending beyond the side wall;

(c) displacing the plunger forwardly in the container toward the outlets in the chambers by applying pressure to the pressure plate in contact with the rearward end of the side wall;

(d) forcing the pressure plate against the free ends of the outside ribs and creating a counter pressure in the fluid substance against the camber; and (e) flexing a center portion of the camber portion rearwardly by the counter pressure and causing the free ends of the inside ribs to contact the pressure plate and exert a side thrust against the lip seal.

* * * * *